US010900391B2

(12) United States Patent
Etzler

(10) Patent No.: US 10,900,391 B2
(45) Date of Patent: Jan. 26, 2021

(54) ENGINE CONTROL SYSTEM AND METHOD FOR CONTROLLING ACTIVATION OF SOLENOID VALVES

(71) Applicant: Continental Automotive Systems, Inc., Auburn Hills, MI (US)

(72) Inventor: Dirk Etzler, Rochester Hills, MI (US)

(73) Assignee: Vitesco Technologies USA, LLC., Auburn Hills, MI (US)

( * ) Notice: Subject to any disclaimer, the term of this patent is extended or adjusted under 35 U.S.C. 154(b) by 40 days.

(21) Appl. No.: 16/007,588

(22) Filed: Jun. 13, 2018

(65) Prior Publication Data

US 2019/0383179 A1 Dec. 19, 2019

(51) Int. Cl.

| | |
|---|---|
| ***F01L 25/08*** | (2006.01) |
| ***F02D 41/20*** | (2006.01) |
| ***F02D 41/22*** | (2006.01) |
| ***F02D 41/24*** | (2006.01) |
| ***F02M 51/06*** | (2006.01) |

(Continued)

(52) U.S. Cl.

CPC ..... *F01L 25/08* (2013.01); *F02D 41/20* (2013.01); *F02D 41/221* (2013.01); *F02D 41/2403* (2013.01); *F02D 41/266* (2013.01); *F02D 2041/227* (2013.01); *F02D 2250/12* (2013.01); *F02M 51/0696* (2013.01); *H01F 7/064* (2013.01)

(58) Field of Classification Search

CPC ..... F01L 25/08; F02D 41/20; F02D 41/221; F02D 41/2403; F02D 2250/12; F02D 2041/227; F02D 41/266; F02M 51/0696; H01F 7/064

See application file for complete search history.

(56) References Cited

U.S. PATENT DOCUMENTS 5,381,297 A 1/1995 Weber
6,453,876 B1 9/2002 Fukutomi et al.

(Continued)

FOREIGN PATENT DOCUMENTS

DE 102007024397 A1 11/2008
DE 102012218157 A1 4/2013

(Continued)

OTHER PUBLICATIONS

The European Patent Office Search Report, dated Nov. 7, 2019, for the European Patent Application No. 19186113.7.

(Continued)

*Primary Examiner* — Hung Q Nguyen
*Assistant Examiner* — Susan E Scharpf

(57) ABSTRACT

A valve controller and method for controlling a valve having a solenoid are disclosed, including receiving a least one input signal, detecting a first edge of the at least one signal and in response to the detection activating the valve. Activating the valve includes activating the valve in a rise-to-peak phase during which the valve is opened, a hold phase following the rise-to-peak phase during which the valve remains open and a current level of the valve is less than a current level of the valve during the rise-to-peak phase, and an ending-of-activation phase following the hold phase during which current ripple in the valve is less than the current ripple in the valve during the hold phase.

21 Claims, 4 Drawing Sheets

(51) Int. Cl.
*H01F 7/06* (2006.01)
*F02D 41/26* (2006.01)

(56) References Cited

U.S. PATENT DOCUMENTS 6,532,940 B1 * 3/2003 Ono ..... F02D 41/20 123/490
6,892,708 B2 5/2005 Nasu
7,561,957 B1 * 7/2009 Santoso ..... F02D 13/0246 701/113
7,789,073 B2 * 9/2010 Miyake ..... F02D 41/20 123/490
9,458,789 B2 * 10/2016 Lucido ..... F02D 41/20
9,476,376 B2 * 10/2016 Imai ..... F02D 41/20
9,593,657 B2 3/2017 Kusakabe
9,970,376 B2 * 5/2018 Nagatomo ..... F02D 41/20
2003/0062029 A1 * 4/2003 Oyama ..... F02D 41/20 123/490
2003/0089332 A1 * 5/2003 Yomogida ..... F02D 41/20 123/299
2004/0223282 A1 * 11/2004 Bolz ..... F16K 31/0679 361/139
2006/0124108 A1 * 6/2006 Puckett ..... F02D 41/20 123/446
2008/0059039 A1 * 3/2008 Nakagawa ..... F02D 41/2464 701/99
2008/0289607 A1 * 11/2008 Mayuzumi ..... F02D 41/20 123/490
2009/0204315 A1 1/2009 Aspelmayr
2009/0243574 A1 2/2009 Mayuzumi
2009/0062029 A1 3/2009 Stites
2009/0107469 A1 4/2009 Takahashi
2009/0177367 A1 * 7/2009 Toyohara ..... F02D 41/20 701/103
2009/0287393 A1 * 11/2009 Moller ..... F02D 41/266 701/103
2010/0263632 A1 4/2010 Miyake
2010/0237266 A1 * 9/2010 Haaf ..... F02M 59/366 251/129.15
2011/0315124 A1 * 12/2011 Richter ..... F02D 41/20 123/480
2012/0180762 A1 * 7/2012 Casasso ..... F02D 41/20 123/472
2013/0139791 A1 6/2013 Kusakabe et al.
2014/0043000 A1 * 2/2014 Bojarski ..... F02D 41/26 323/272
2014/0124601 A1 * 5/2014 Imai ..... F02D 41/20 239/585.1
2014/0238354 A1 * 8/2014 Imai ..... F02M 51/005 123/478
2016/0177855 A1 6/2016 Kusakabe et al.
2017/0051696 A1 2/2017 Mukaihara et al.
2017/0138328 A1 * 5/2017 Takei ..... F02P 5/1506
2017/0342937 A1 11/2017 Nakano
2017/0358387 A1 * 12/2017 Etzler ..... H01F 7/064
2018/0017005 A1 1/2018 Kusakabe et al.
2018/0363608 A1 * 12/2018 Kusakabe ..... F02M 51/0653
2020/0025122 A1 * 1/2020 Etzler ..... F16K 31/02

FOREIGN PATENT DOCUMENTS

EP 2119895 A1 11/2009
JP 2013087717 A 5/2013
JP 2016048069 A 4/2016
WO 2015039095 A1 3/2015

OTHER PUBLICATIONS

Korean Office Action dated May 27, 2020 for KR patent application 10-2019-0086020.
File history for U.S. Appl. No. 16/036,996, including non-final Office Action dated May 15, 2020.
Korean Intellectual Property Office Notice to Submit Response dated May 27, 2020 for related Korean Patent Application No. 10-2019-0086020.

* cited by examiner

ENGINE CONTROL SYSTEM AND METHOD FOR CONTROLLING ACTIVATION OF SOLENOID VALVES

CROSS REFERENCE TO RELATED APPLICATION

The present application is related to U.S. patent application Ser. No. 15/176,270, filed Jun. 8, 2016 and titled "Engine Control System and Method for Controlling Actuation of Solenoid Valves," the content of which is incorporated by reference herein in its entirety.

TECHNICAL FIELD

The technical field relates generally to control techniques for solenoid valves and more particularly to controlling fuel injector valves in an internal combustion engine.

BACKGROUND

Solenoid actuators for (direct) injection valves and intake valves are operated by controlling the current through its coil (which behaves as a resistive-inductive load) according to a specified current profile. As an example, FIG. 1 shows a typical current profile that is used to activate a solenoid direct injection valve. The current profile includes various activation phases having different parameter definitions. All of the activation phases of the current profile are run through in sequence based on time or current criteria until the end of activation EOA has been reached. The current profile includes a rise-to peak phase 10 in which injector valve current rises to open the injector valve, followed by a hold phase 20 in which a regulated current level of the injector valve is less than a current level of the injector valve in the rise-to-peak phase but which holds the injector valve in the open state. The hold phase 20 is continued until the control signal NON is de-asserted. The control signal NON defines the start of activation SOA as corresponding to the control signal NON being asserted, and defines the end of activation EOA as corresponding to the control signal NON being de-asserted.

FIG. 2 illustrates accuracy and repeatability with respect to the end of activation EOA. The term "accuracy" specifies the mean delay between de-asserting the control signal NON and the resulting decay of the injector solenoid current. The term "repeatability" describes the time deviation of the decay from the mean value (i.e., jitter). Due to the systematic nature of the delay, this error may be compensated by adjusting the duration of control signal NON. Since the jitter is random in nature, it cannot be compensated for. Instead, the jitter needs to be reduced or otherwise minimized by design.

Depending on a set of external engine conditions, such as the requested output torque and power of the engine or the rail pressure, the needed fuel mass is changed by varying the activation time of the injector. The activation of the injector is controlled by the main microcontroller with help of the digital control signal NON. The injector will be activated using the specified current profile when the control signal is asserted (in this case, when the control signal NON transitions to a logic low state) and deactivated when the control signal is de-asserted (when the control signal NON transitions to a logic high state).

A significant portion of the activation time tolerance is given by the delay and jitter of the final current phase at the end of the activation EOA. When the control signal NON is de-asserted (e.g., when signal NON transitions from logic low to logic high), all NMOS switches of the power stage driving the injector solenoid are turned off, leading to a fast decaying injector current. Due to a non-ideal power stage, there is a systematic delay between the rising edge of the control signal NON and the decay of the injector current. Furthermore, an inherent statistical variation of the injector current level at the moment of the control signal de-assertion from one activation to the next leads to shot-to-shot timing variation (i.e., jitter) of the current decay. That means that the higher the current ripple during the regulated current hold phase 20, the higher the shot-to-shot variation of the current decay. FIG. 2 illustrates timing details with respect to the tolerance of the end of activation EOA.

Whereas all systematic errors (e.g., delay) can be compensated by adjusting the duration of the control signal NON, the random, statistical part (e.g., shot-to-shot variation) of the error cannot be counterbalanced. Thus, in order to reduce the shot-to-shot variation, the current ripple should to be reduced or otherwise minimized. On the other hand, reducing the current ripple leads to a higher switching frequency of the NMOS switches and thus to higher switching losses. For design reasons, there is a maximum limit to the power loss and consequently to a reduction of the current ripple.

A dedicated application specific integrated circuit ("ASIC") may be utilized to control the injector valves. As such, the ASIC applies current to the injector solenoid according to the current profile definition based on instructions and commands received from an external processor.

As such, it is desirable to present a system and method for efficiently controlling actuation of solenoid injector valves. In addition, other desirable features and characteristics will become apparent from the subsequent summary and detailed description, and the appended claims, taken in conjunction with the accompanying drawings and this background.

BRIEF SUMMARY

Example embodiments overcome deficiencies in existing control devices for solenoid injector valves. In an example embodiment, a valve controller includes a first input and a first output for coupling to the valve. The valve controller is configured to selectively activate the valve following receipt of a first edge of a first input signal at the first input. The valve activation includes a rise-to-peak phase followed by a hold phase in which a current level of the valve during the hold phase is less than a current level of the valve in the rise-to-peak phase, and an ending-of-activation phase following the hold phase in which current ripple of the valve is less than the current ripple of the valve in the hold phase.

The valve controller transitions activation of the valve from the hold phase to the ending-of-activation phase following receipt of a second edge of the first input signal at the first input. In an example embodiment, the duration of the ending-of-activation phase is predetermined. The duration of the hold phase is larger than the duration of the ending-of-activation phase. The first edge of the first input signal is a falling edge and the second edge of the first input signal is a rising edge which follows the falling edge. The valve controller transitions activation of the valve from the hold phase to the ending-of-activation phase in response to receipt of a second edge of the first input signal at the first input. The valve includes a fuel injector for a motor vehicle having a combustion engine such that the valve controller controls the fuel injector. The valve controller includes an application specific integrated circuit (ASIC), the ASIC having at least one state machine. The at least one state machine generates a first output signal at the first output for receipt by the valve, which activates the valve in the rise-to-peak phase, the hold phase and the ending-of-activation phase. An amount of jitter of the current valve is less than the amount of jitter of the current valve without the valve being activated in the ending-of-activation phase.

A method of controlling a solenoid injector valve includes receiving a first input signal; detecting a first edge of the first input signal; and in response to detecting the first edge of the first input signal, activating the valve. Valve activating includes activating the valve in a rise-to-peak phase during which the valve is opened, a hold phase following the rise-to-peak phase during which the valve remains open and a current level of the valve is less than a current level of the valve during the rise-to-peak phase, and an ending-of-activation phase following the hold phase during which current ripple in the valve is less than the current ripple in the valve during the hold phase.

The method further includes detecting a second edge of the first input signal, wherein activating the valve in the ending-of-activation phase occurs in response to detecting the second edge of the first input signal. The first edge is a falling edge of the first input signal and the second edge of the first input signal is a rising edge thereof. The second edge of the first input signal is the next edge thereof in succession following the first edge of the first input signal.

The method may further include detecting a second edge of the first input signal, wherein activating the valve in the ending-of-activation phase occurs following detecting the second edge of the first input signal. Activating the valve in the ending-of-activation phase occurs over a predetermined period of time. The predetermined period of time is fixed each instance during which the valve is activated. In one aspect, the duration of the hold phase is greater than a duration of the ending-of-activation phase. In another aspect, the duration of the ending-of-activation phase is greater than the duration of the hold phase.

BRIEF DESCRIPTION OF THE DRAWINGS

Other advantages of the disclosed subject matter will be readily appreciated, as the same becomes better understood by reference to the following detailed description when considered in connection with the accompanying drawings wherein.

DETAILED DESCRIPTION

Referring to the FIGS. 3-6, wherein like numerals indicate like parts throughout the several views, an engine control system and method of controlling actuation of a solenoid valve are shown and described herein.

Figure 3:
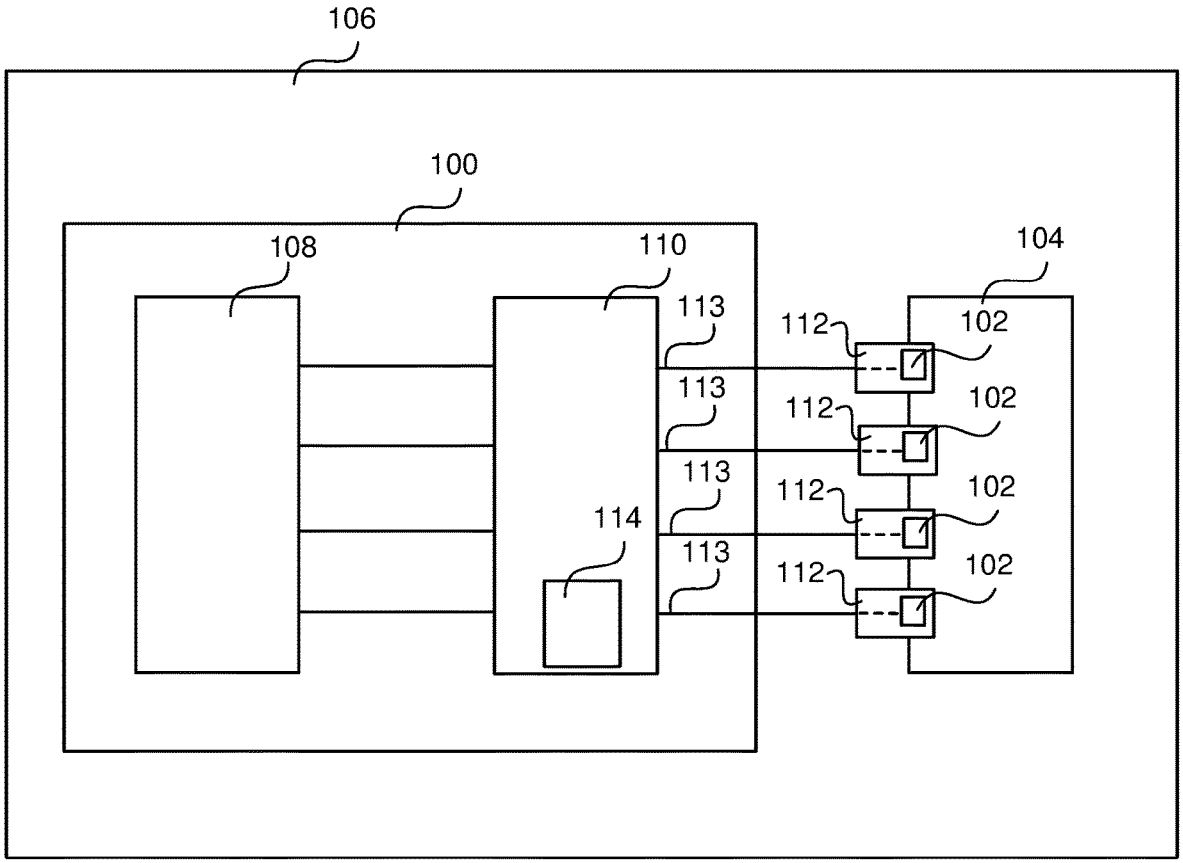
FIG. 3 is a diagram of a vehicle having an engine control system, according to an example embodiment.

Referring to FIG. 3, the engine control system 100 of an example embodiment is utilized to control at least one aspect of an engine 104 of a vehicle 106. The engine 104 may be an internal combustion engine fueled with, for example, a petroleum product such as gasoline or diesel fuel. Of course, those skilled in the art appreciate that other fuels may be utilized with the engine 104 and/or that other types of engine 104 may be implemented. The vehicle 106 may be an automobile, truck, tractor, motorcycle, boat, aircraft, etc., as is readily appreciated by those skilled in the art.

The engine control system 100 includes a processor 108. The processor 108 is capable of performing calculations, manipulating data, and/or executing instructions, i.e., running a program. The processor 108 may be implemented with a microprocessor, microcontroller, application specific integrated circuit ("ASIC"), and/or other device(s) (not shown) as appreciated by those skilled in the art. The processor 108 may include a memory (not shown) for storing data and/or instructions as is also appreciated by those skilled in the art.

The engine control system 100 also includes a valve controller 110. In the example embodiment, the valve controller 110 is independent from the processor 108 and is implemented with an ASIC. The valve controller 110 generates control signals for controlling one or more valves 112. The valve controller 110 may include one or more state machines which generate the control signals for the valves 112. However, it should be appreciated that the valve controller 110 may be implemented with other devices and/or circuitry as appreciated by those skilled in the art.

The valve controller 110 is in communication with the processor 108. As such, instructions and/or data may be sent at least from the processor 108 to the valve controller 110, as described in greater detail below.

In the illustrated embodiment, the valve controller 110 is also in communication with a plurality of valves 112. As shown in FIG. 3, four valves 112 are utilized, each in communication with the valve controller 110 such that each valve 112 is controlled thereby. In this example embodiment, the valves 112 are each direct injection valves 112 for directly injecting fuel into a cylinder (not shown) of the engine 104. However, it should be appreciated that the valves 112 may be other types of fuel valves and/or serve other purposes. For example, one or more of the valves 112 may be an intake valve for regulating air and/or fuel flow to the cylinder(s).

In the example embodiment, each valve 112 includes a solenoid 102 mentioned above. As appreciated by those skilled in the art, the solenoid 102 activates and/or actuates the valve 112 between positions and/or states, such as an open position and a closed position. That is, the solenoid 102 opens the valve to allow fluid, in this case fuel, to flow therethrough and closes the valve to prevent fluid from flowing. The solenoid 102 is in communication with the valve controller 110. As such, the valve controller 110 may generate one or more output control signals 113 and/or other data for controlling activation of each valve 112 and/or the solenoid 102 thereof. In an example embodiment, each valve 112 and/or solenoid 102 is controlled by a distinct set of one or more control signals 113. Each control signal 113 may be a pair of differential signals.

Figure 4:
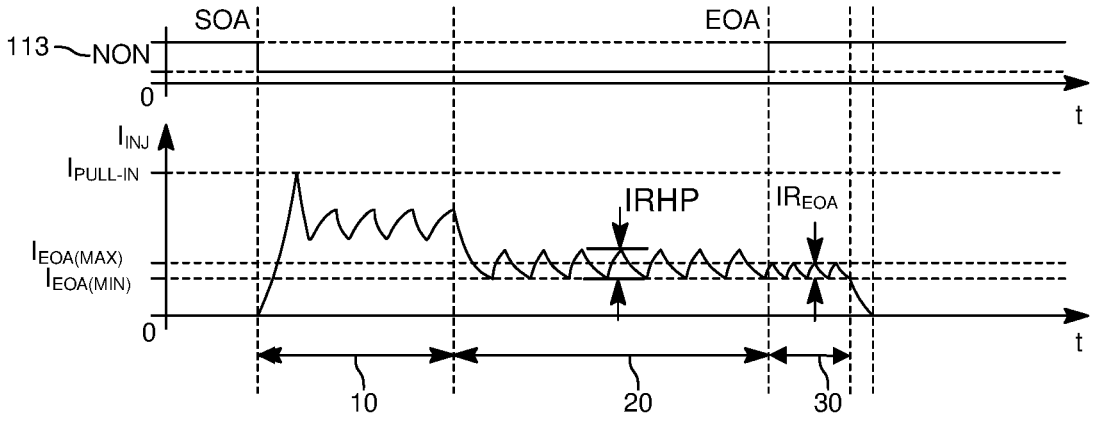
FIG. 4 is waveform of a current profile for operating a solenoid valve according to an example embodiment.

In an example embodiment, the valve controller 110 includes a memory 114 for storing, among other things, at least one current profile. A current profile defines the electric current in each solenoid 102 and/or valve 112 throughout valve activation. FIG. 4 depicts a current profile 400 for each solenoid 102 and/or valve 112 during valve activation, according to an example embodiment. Similar to the conventional current profile of FIG. 1, the current profile includes a rise-to-peak phase 10 during which current levels in the solenoid 102 are such as to open the corresponding valve 112, and a hold phase 20 which follows the rise-to-peak phase 10 and during which current levels in the solenoid 102 are sized to maintain valve 112 in the open position. FIG. 4 illustrates the amount of current ripple $IR_{HP}$ during this activation phase. According to example embodiments, the current profile 400 includes another phase 30 which follows the hold phase 20 and during which the amount of current ripple $IR_{EOA}$ in solenoid 102 is reduced compared to the amount of current ripple $IR_{HP}$ during the hold phase 20. The amount of current ripple is reduced by, for example, increasing the switching frequency of the drive transistors (not shown) in the valve controller 110 for the valve 112. Increasing the switching frequency will lead to greater switching losses in the phase 30. However, by limiting the time duration of this phase 30, the increase in power loss during the phase 30 is relatively limited and unappreciable. The phase 30 occurs after the hold phase 20 and just prior to the end of the activation period for valve 112, and is hereinafter referred to as the ending-of-activation phase 30. In this way, the example embodiments effectively separate the hold phase 20 from the ending-of-activation phase 30 having reduced current ripple $IR_{EOA}$, thereby maintaining no increase in power loss during the hold phase 20.

Figure 1:
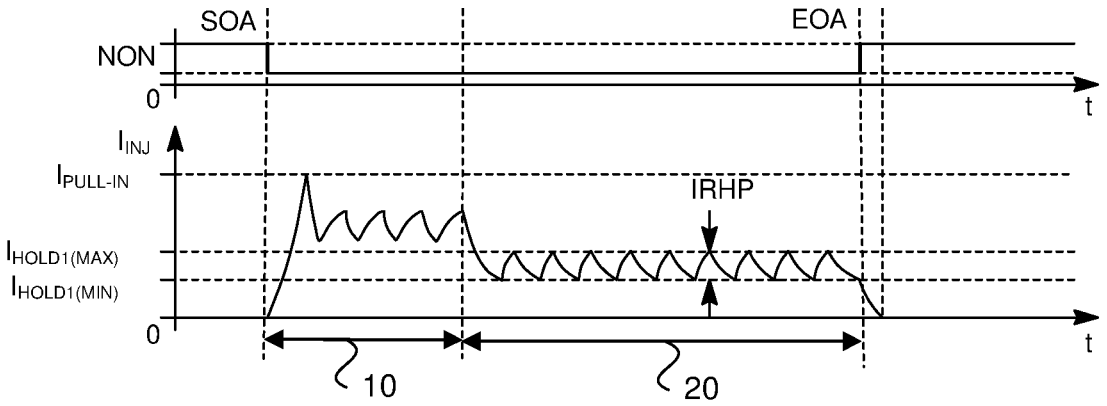
FIG. 1 (PRIOR ART)
FIG. 1 is a waveform of a known current profile for operating a solenoid valve.

Valve activation in the rise-to-peak phase 10 occurs in response to a triggering and/or asserting edge of control signal 113, which in the embodiment illustrate in FIGS. 1 and 4 is the falling edge of control signal 113. In addition, valve activation transitions from the hold phase 20 to the ending-of-activation phase 30 following and in response to a rising (de-asserting) edge of control signal 113 which follows the above-identified falling edge thereof.

In an example embodiment, ending-of-activation phase 30 has a time duration that is fixed at a predetermined amount such that the time duration of the ending-of-activation phase 30 in each instance of valve activation is the same. In an example embodiment, the valve controller 110 is implemented as or otherwise includes a state machine having timing circuitry for, among other things, setting the time duration of the ending-of-activation phase 30.

Figure 2:
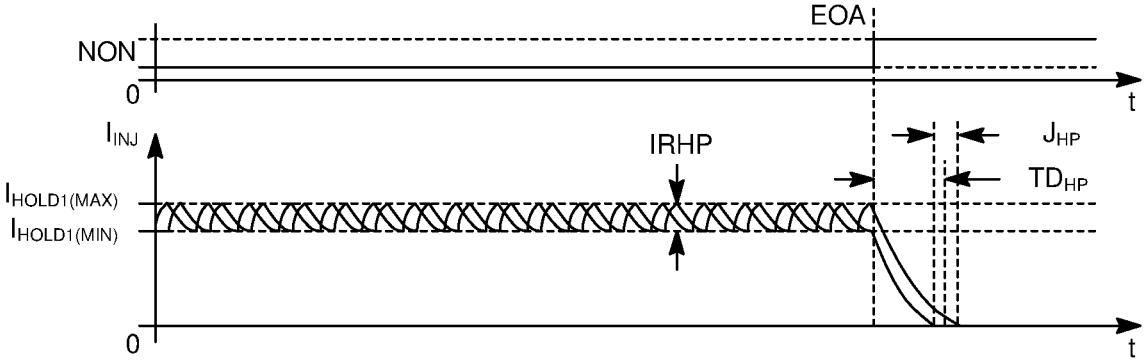
FIG. 2 (PRIOR ART)
FIG. 2 is a waveform of a detailed portion of the current profile of FIG. 1.
Figure 5:
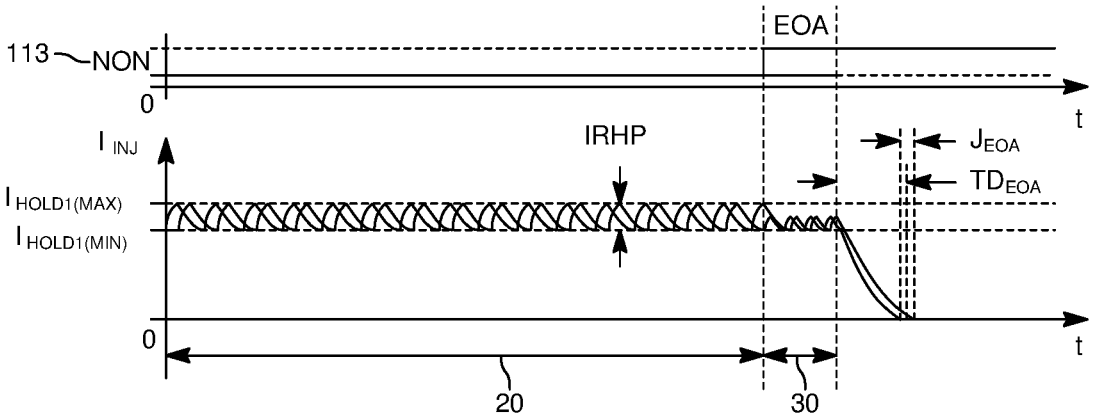
FIG. 5 is a waveform of a detailed portion of the current profile for operating a solenoid valve of FIG. 4.

FIG. 5 illustrates that as a result of the reduced current ripple $IR_{EOA}$ in a valve 112 during the ending-of-activation phase 30, relative to the amount current ripple $IR_{HP}$ during the corresponding hold phase 20, the amount of jitter $J_{EOA}$ following the ending-of-activation phase 30 is reduced relative to the amount of jitter $J_{HP}$ seen in existing valve activations of FIG. 1 which do not include the ending-of-activation phase 30. The reduced jitter $J_{EOA}$ results in valve activation having better accuracy and repeatability. Further, the time delay $TD_{EOA}$ between the end of the ending-of-activation phase 30 and the time when current in the valve 112 no longer exists is noticeably smaller due to the reduced current ripple $IR_{HP}$, relative to the time delay $TD_{HP}$ seen in the current profile of FIG. 2 which does not include an ending-of-activation phase 30.

The valve controller 110 described above is configured to execute the method 600 of controlling the activation of the solenoids 102, as described below and with reference to FIG. 6. However, it should be appreciated that the method 600 described herein may be practiced with other devices besides the vehicle 106, engine 104, valve controller 110 and engine control system 100 described above.

Figure 6:
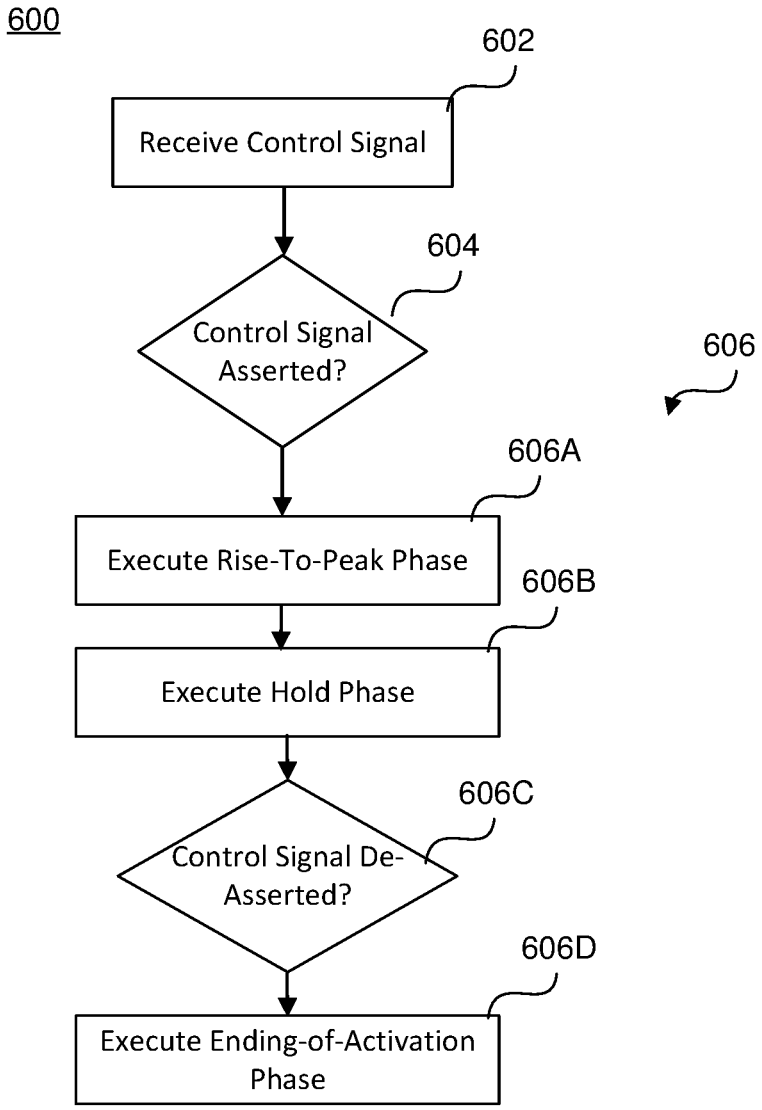
FIG. 6 is flowchart of a method of controlling a solenoid valve according to an example embodiment.

With reference to FIG. 6, method 600 illustrates the operation of the valve controller 110 according to an example embodiment. For simplicity, the method 600 will be described with respect to controlling a single valve 112, and it is understood that the described method is applicable to each valve 112 of the engine 104. Method 600 includes the valve controller 110 receiving control signal 113 for a valve 112 at 602 and determining, at 604, whether an asserting (in this case, falling) edge of control signal 113 occurs. A negative determination results in the valve controller 110 returning to act 602. A positive determination that an asserting (falling) edge of control signal 113 occurs results in the valve controller 110 causing the execution of a valve activation cycle at 606, including the acts of executing a rise-to-peak phase 10 at 606A, followed by executing a hold phase 20 at 606B. Next, and while the valve 112 is in the hold activation phase 20, the valve controller 110 determines whether a de-asserting (rising) edge of the control signal 113 occurs at 606C. If no such edge is detected/determined, the valve controller 110 continues activating the valve 112 in the hold phase 20. Upon a de-asserting edge of the control signal 113 being determined/detected, the valve controller 110 in response causes at 606D the execution of the ending-of-activation phase 30. As mentioned, the ending-of-activation phase 30 is performed for a predetermined period of time, during which current ripple $IR_{EOA}$ is reduced relative to the amount of current ripple $IR_{HP}$ during the hold phase 20. This is accomplished by increasing the switching frequency of the drive transistors in the valve controller 110 which drive the solenoid 102 of the valve 112. Though the amount of power loss is increased during this phase 30, the amount of power loss during the longer hold phase 30 is unaffected. The present invention has been described herein in an illustrative manner, and it is to be understood that the terminology which has been used is intended to be in the nature of words of description rather than of limitation. Obviously, many modifications and variations of the invention are possible in light of the above teachings. The invention may be practiced otherwise than as specifically described within the scope of the appended claims.

What is claimed is:

1. A valve controller configured to control a valve having a solenoid, the valve controller comprising:

a first input and at least one output for coupling to the valve, the valve controller configured to selectively activate the valve following receipt of a first edge of a first signal at the first input, the valve activation including a rise-to-peak phase followed by a hold phase in which a current level of the valve during the hold phase is less than a current level of the valve in the rise-to-peak phase, and an ending-of-activation phase following the hold phase in which current of the valve during the hold phase is maintained but current ripple of the valve is less than the current ripple of the valve in the hold phase wherein the valve comprises a fuel injector for a motor vehicle having a combustion engine such that the valve controller controls the fuel injector.

2. The valve controller according to claim 1, wherein the valve controller transitions activation of the valve from the hold phase to the ending-of-activation phase following receipt of a second edge of the first input signal at the first input.

3. The valve controller according to claim 2, wherein a duration of the ending-of-activation phase is predetermined.

4. The valve controller according to claim 3, wherein a duration of the hold phase is larger than the duration of the ending-of-activation phase.

5. The valve controller according to claim 2, wherein the first edge of the first signal is a falling edge and the second edge of the first signal is a rising edge which follows the falling edge.

6. The valve controller of claim 2, wherein following receipt of the second edge of the first input signal at the first input, the valve controller transitions activation of the valve from the ending-of-activation phase to a closing phase during which the valve is closed, and wherein the valve is opened during the rise-to-peak phase and is maintained in the opened position throughout both the hold phase and the ending-of-activation phase.

7. The valve controller according to claim 1, wherein the valve controller transitions activation of the valve from the hold phase to the ending-of-activation phase in response to receipt of a second edge of the first input signal at the first input.

8. The valve controller of claim 1, wherein the valve controller comprises an application specific integrated circuit (ASIC), the ASIC including at least one state machine, the at least one state machine generating at least one output signal for receipt by the valve which activates the valve in the rise-to-peak phase, the hold phase and the ending-of-activation phase.

9. The valve controller of claim 1, wherein during the ending-of-activation phase, the valve controller increases a switching frequency of drive transistors which control a solenoid of the valve, relative to the switching frequency of the drive transistors during the hold phase.

10. The valve controller of claim 1, wherein a range of current of the valve during the ending-of-activation phase falls within only a portion of a range of the current of the valve during the hold phase.

11. A valve controller configured to control a valve having a solenoid, the valve controller comprising:

a first input and at least one output for coupling to the valve, the valve controller configured to selectively activate the valve following receipt of a first edge of a first signal at the first input, the valve activation including a rise-to-peak phase followed by a hold phase in which a current level of the valve during the hold phase is less than a current level of the valve in the rise-to-peak phase, and an ending-of-activation phase following the hold phase in which current ripple of the valve is less than the current ripple of the valve in the hold phase, wherein an amount of current jitter of the valve is less than the amount of current jitter of the valve without the valve being activated in the ending-of-activation phase wherein the valve comprises a fuel injector for a motor vehicle having a combustion engine such that the valve controller controls the fuel injector.

12. A method of controlling a valve having a solenoid, comprising:

receiving a least one input signal;

detecting a first edge of the at least one input signal; and in response to detecting the first edge of the at least one input signal, activating the valve, comprising activating the valve in a rise-to-peak phase during which the valve is opened, a hold phase following the rise-to-peak phase during which the valve remains open and a current level of the valve is less than a current level of the valve during the rise-to-peak phase, and an ending-of-activation phase following the hold phase during which current ripple in the valve is less than the current ripple in the valve during the hold phase, wherein activating the valve in the ending-of-activation phase comprises increasing a switching frequency of drive transistors which drive a solenoid in the valve, relative to the switching frequency of the drive transistors during the hold phase wherein the valve comprises a fuel injector for a motor vehicle having a combustion engine such that the valve controller controls the fuel injector.

13. The method according to claim 12, further comprising detecting a second edge of the at least one input signal, wherein activating the valve in the ending-of-activation phase occurs in response to detecting the second edge of the at least one input signal.

14. The method according to claim 13, wherein the first edge is a falling edge of the at least one input signal and the second edge of the at least one input signal is a rising edge of the at least one input signal, the second edge of the at least one input signal being a next edge thereof following the first edge of the at least one input signal.

15. The method according to claim 12, further comprising detecting a second edge of the at least one input signal, wherein activating the valve in the ending-of-activation phase occurs following detecting the second edge of the at least one input signal.

16. The method according to claim 12, wherein activating the valve in the ending-of-activation phase occurs over a predetermined period of time.

17. The method according to claim 16, wherein the predetermined period of time is fixed at the predetermined period of time in each instance in which the valve is activated.

18. The method according to claim 12, wherein a duration of the hold phase is greater than a duration of the ending-of-activation phase.

19. The method according to claim 12, wherein a duration of the ending-of-activation phase is greater than a duration of the hold phase.

20. The method of claim 12, wherein during the ending-of-activation phase current is maintained at the current level of the valve in the hold phase, with a range of the current of the valve during the ending-of-activation phase being within only a portion of a range of the current during the hold phase.

21. The method of claim 12, wherein an amount of current jitter of the valve is less than the amount of current jitter of the valve without the valve being activated in the ending-of-activation phase.

* * * * *